US005919524A

United States Patent [19]

Paloviita et al.

[11] Patent Number: 5,919,524

[45] Date of Patent: Jul. 6, 1999

[54] BLADE METERING UNIT AND METHOD FOR BLADE-COATING A MATERIAL WEB

[75] Inventors: Petri Paloviita, Vantaa; Jukka Koskinen, Helsinki, both of Finland

[73] Assignee: Valmet Corporation, Helsinki, Finland

[21] Appl. No.: 09/015,805

[22] Filed: Jan. 29, 1998

Related U.S. Application Data

[63] Continuation of application No. 08/644,676, May 7, 1996, Pat. No. 5,741,550, which is a continuation of application No. 08/329,998, Oct. 27, 1994, abandoned.

[30] Foreign Application Priority Data

Oct. 27, 1993 [FI] Finland ..... 934767

[51] Int. Cl.[6] ..... B05D 3/04

[52] U.S. Cl. ..... 427/348; 427/356; 427/359; 118/410; 118/413; 118/414; 118/63

[58] Field of Search ..... 427/348, 356, 427/359; 118/410, 411, 413, 414, 63

[56] References Cited

U.S. PATENT DOCUMENTS

| | | | |
|---|---|---|---|
| 3,235,401 | 2/1966 | Fowells et al. . | |
| 3,329,523 | 7/1967 | Best et al. . | |
| 4,521,459 | 6/1985 | Takeda | 427/359 |
| 4,537,801 | 8/1985 | Takeda | 427/356 |
| 4,839,201 | 6/1989 | Rantanen et al. . | |
| 4,869,933 | 9/1989 | Sollinger et al. . | |
| 5,104,697 | 4/1992 | Heikkinen et al. . | |
| 5,122,396 | 6/1992 | Rantanen . | |
| 5,368,893 | 11/1994 | Sommer et al. . | |
| 5,741,550 | 4/1998 | Paloviita et al. | 427/348 |

FOREIGN PATENT DOCUMENTS

| | | | |
|---|---|---|---|
| 1 230 965 | 1/1988 | Canada . | |
| 2089918 | 8/1993 | Canada . | |
| 2 553 305 A1 | 4/1985 | France . | |
| 3446525 | 8/1985 | Germany | 118/410 |
| 43 36 365 A1 | 4/1994 | Germany . | |
| 59-22684 | 2/1984 | Japan | 118/63 |
| 2 265 846 | 10/1993 | United Kingdom . | |
| 2 272 390 | 5/1994 | United Kingdom . | |

OTHER PUBLICATIONS

Wochenblatt Fur Papierfabrikation 23/24 1988, pp. 1053–1057 (No Month Date).

*Primary Examiner*—Katherine A. Bareford
*Attorney, Agent, or Firm*—Cohen, Pontani, Lieberman & Pavane

[57] ABSTRACT

A method and apparatus for applying a coat mix to a high-speed running board or paper web by accurately premetering and pre-smoothing the applied coat with an applicator apparatus and then minimally doctoring the applied coat with an air knife. The applicator apparatus has a narrow slot-orifice extending in a cross-machine direction for facilitating high-speed laminar flow of coating mix into a gap region defined by confronting surfaces of the applicator apparatus and the web. The applicator apparatus has a member for directing the ejected coating mix in the gap region in a direction reverse to a travel direction of the web so that only a predetermined portion of the ejected coating mix is allowed to form an applied coat on the web. This accurate premetering of the coating mix by the applicator apparatus permits an operator to readily optimize the subsequent process of doctoring the applied coating with an air knife.

20 Claims, 5 Drawing Sheets

BLADE METERING UNIT AND METHOD FOR BLADE-COATING A MATERIAL WEB

RELATED APPLICATIONS

This is a continuation of application Ser. No. 08/644,676 filed May 7, 1996, now U.S. Pat. No. 5,741,550, which is a continuation of application Ser. No. 08/329,998 filed Oct. 27, 1994, now abandoned.

FIELD OF THE INVENTION

The present invention relates to a method and apparatus for coating a board or paper web using an air knife as the doctoring means.

BACKGROUND OF THE INVENTION

When using an air doctor, the coating mix applied to the web is smoothed by directing a high-velocity air jet via a slot-orifice nozzle of the air doctor toward the web. This air knife removes the excess coat from the web surface in the form of a coat mist which is collected into a specially designed blow-off hood and recycled back to the coating mix pan. With the help of the air doctor, a smooth coat is attained and the profile of the coated paper or paperboard web follows the contour of the base web. The opacifying power of the applied coat is good. However, this method is not suitable for applying high-solids coats.

The greatest drawback of air doctoring is its inherently weak blow-off capability of removing the excess coat, which capability is further impaired at higher web speed. Consequently, air doctoring must employ coating furnishes of low viscosity and solids content, and even so the usable web speed remains less than 500 m/min in even the fastest machines. For these reasons, air doctoring is used almost exclusively in board coating where good opacifying power is imperative and high web speeds are not as critical as in papermaking in general. If the viscosity or solids content of the coating mix is increased, the air doctor loses its ability to blow off the excess coat and, therefore, the finished coat weight becomes excessively heavy. Accordingly, the requirements set for air doctor coating are that the applied coat should be as smooth as possible and the weight of the applied coat should closely approximate the desired finished coat weight.

U.S. Pat. No. 3,235,401 discloses an air doctor apparatus in which the web to be coated is directed, first to a metering roll of the applicator apparatus via a guide roll. The metering roll is placed in the coating mix pan so that the lower part of the roll is immersed in the pan, while the web runs over the upper part of the roll. The metering roll lifts an excess amount of the mix from the pan to the web which then passes over a rotating predoctoring rod that removes a portion of the excess coat from the web. The purpose of the predoctoring rod is to smooth the coat and remove so much of the excess coat that the air knife can then doctor the coat to the desired finished coat weight. After the predoctoring rod, the web travels onto a backing roll having a closely-disposed air knife so as to blow a narrow-slitted air jet in the reverse direction to the web travel and to thus doctor the coat to its finished weight.

Several variants of the above-described type of apparatus are known in the art, and they constitute the basic construction or use of air doctors. A drawback of these doctor apparatus is the rapid decrease of their doctoring performance in terms of coat quality and smoothness at higher web speeds.

Patent publication WO 91/17309 discloses an apparatus which is further developed from that described above in that the coat quality and maximum usable web speed during coating have been improved. The apparatus described in WO 91/17309 is otherwise similar to the apparatus described in U.S. Pat. No. 3,235,401, except that the applicator roll is complemented by a doctoring bar which performs both smoothing and metering of the coat transferred from the coating mix pan to the web. In this fashion, the coat applied to the web attains better smoothness and the coat weight is more accurately reduced to the desired finished coat weight. Such an arrangement has the advantage that the air knife need not remove a great amount of excess coat and the coat will have improved smoothness since the initially applied coat is already relatively smooth. Bar smoothing of the coat applied to the web also improves the quality of the end product and permits a higher web speed owing to the reduced blow-off duty imposed on the air knife. In addition, bar smoothing obviates the need to use a rotating predoctoring/metering roll.

Though the above-described apparatus is capable of overcoming certain drawbacks of air doctor techniques, there remain several disadvantages mostly related to the applicator roll method. When running at a high web speed, the applicator roll causes vigorous splashing of the coating mix which then finds its way all over the machinery, including the web and the surroundings. As the rotational speed of the applicator roll is greatly increased at higher web speeds, splashing becomes particularly problematic at the highest web speeds. When using an applicator roll, uncoated spots will remain on the web. Further, the web tension profile has a significant effect on the thickness of the applied coat, and since the air doctor is incapable of smoothing away large variations in coat weights, changes in the web tension profile are directly evidenced by quality defects. Moreover, the roll applicator is characterized by a type of inherent quality defect, namely, the orange peel pattern caused by the splitting of the coat film at the outgoing side of the contact point between the web and the applicator roll; this orange peel pattern cannot be effectively removed by means of air doctoring, particularly if the web speed is high.

A roll applicator cannot be used for applying low coat weights on the web since it results in mottling of the web with uncoated spots. Furthermore, the control of the cross-machine profile of the applied coat becomes rather impossible.

SUMMARY OF THE INVENTION

It is an object of the present invention to provide a coating apparatus with an air doctor, which apparatus offers higher web speed and improved finished quality of the coated web.

The invention is based on applying a layer of coating mix of precise thickness onto the web by means of a narrow slot-orifice applicator operating with a counterflow in the reverse direction to the web travel and having precise control of the mass flow of the coat mix applied to the web so as to achieve a desired coat weight.

The present invention is capable of overcoming most of the drawbacks of the roll applicator method. Use of the slot-orifice applicator permits precise metering of the amount of coating mix applied to the web close to the desired coat weight, thereby minimizing the quantity of coating to be removed by an air doctor. Since the amount of coating mix removed is small, the web speed can be increased without compromising the quality of the end product. The machine-direction coat profile remains smooth irrespective of web tension variations, and the cross-machine direction coat profile can be kept smooth within a narrow tolerance, or alternatively, controlled in a desired manner to take into account the profile variations of the board base web. In accordance with another aspect of the invention, the apparatus provides good controllability and is suited for application of low-coat weights without the hazard of coat mottling.

The method in accordance with the present invention is free from splashing or the "orange peel effect", thereby reducing the need for subsequent cleaning, and thus offers direct improvement of availability and coat quality. The web surface is subjected to lower application pressure than that applied by roll applicators. The lower pressure reduces water penetration into the web and permits the machine to run at a reduced drying capacity and to use a coating mix with slightly higher solids content because of the reduced amount of water transferred from the coat to the web. The finished coat has excellent smoothness since the slot-orifice applicator, in accordance with the present invention, is capable of applying a high-smoothness coat with a weight that is extremely close to the desired finished coat weight. The runnability of the apparatus is good owing to the excellent control facilities offered by the method for optimizing the critical operating parameters of the air knife under widely varying process conditions including web speed variations.

BRIEF DESCRIPTION OF THE DRAWINGS

In the drawings, wherein like reference characters denote similar elements throughout the several views.

DETAILED DESCRIPTION OF THE PREFERRED EMBODIMENTS

The term "slot-orifice applicator apparatus" is used herein to refer to an applicator apparatus in which coating mix is transferred to the surface of a web by direct extrusion through a narrow slot orifice. Smooth spreading of the coating mix is ensured by, for example, a doctor blade, rod, grooved rod, or alternatively extruding the coating mix on the web at a high speed via a narrow slot orifice.

Figure 1:
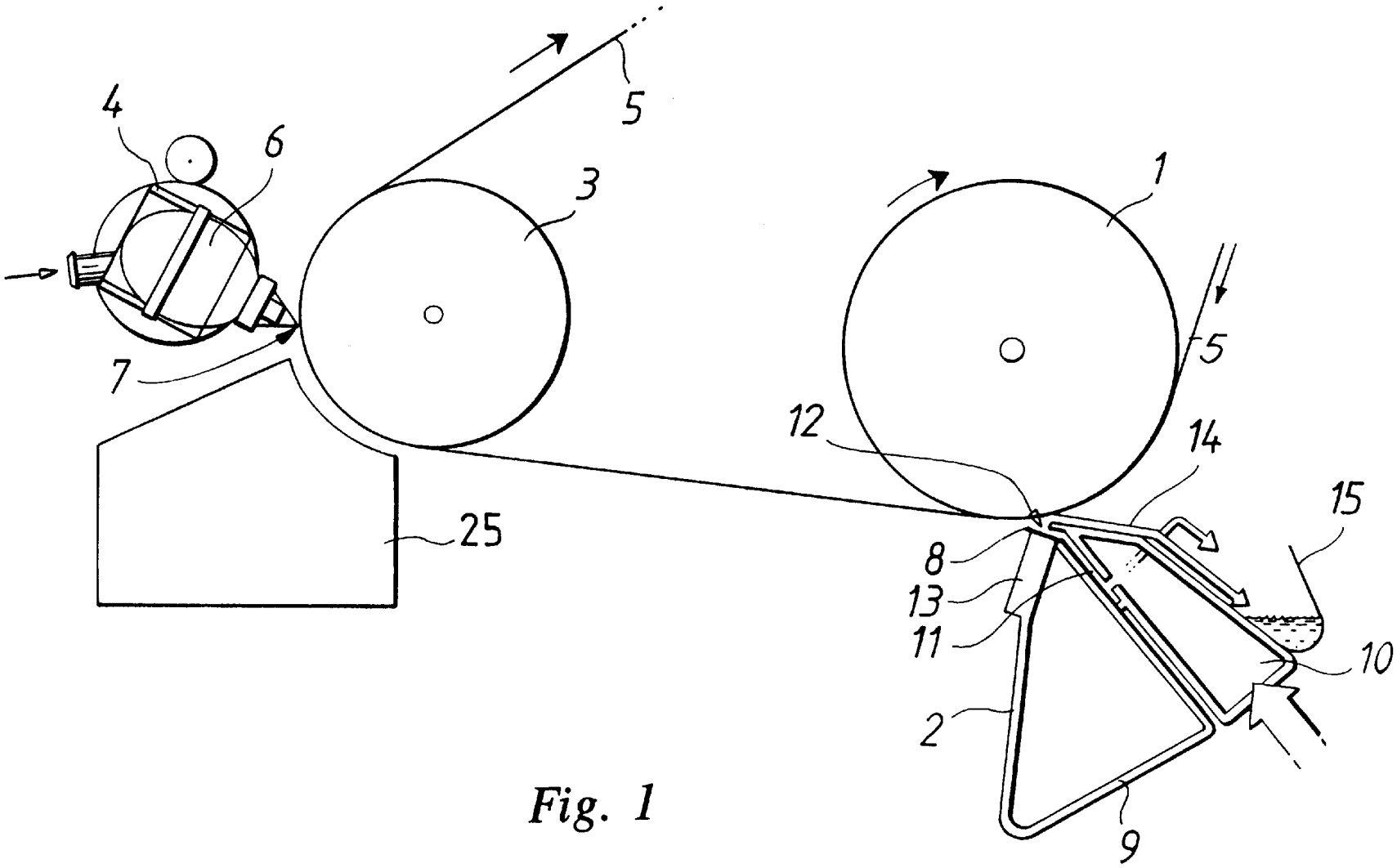
FIG. 1 is a diagrammatic side view of an embodiment of the slot-orifice applicator apparatus in accordance with the present invention.

As seen in FIG. 1, the coater apparatus comprises a first backing roll 1, an applicator apparatus 2 adapted in conjunction therewith, a second backing roll 3 disposed following the applicator apparatus 2 in the travel direction of a web 5, and an air knife 4 disposed proximate the second backing roll 3. The web 5 passes partially around the first backing roll 1, then through the nip between the first backing roll 1 and the applicator apparatus 2 and then to the second backing roll 3, on which the web 5 further passes through the nip between the second backing roll 3 and the air knife 4. The diameter of the second backing roll 3 may be smaller than that of the first backing roll 1; when the web 5 bends over the backing roll 3 at a smaller radius of curvature, the efficiency of the air doctor in blowing off the excess coat from the surface of the web 5 is increased. However, such an arrangement is not mandatory and the design criteria of the roll diameters can be based on different aspects or parameters as well. FIG. 1 shows that the coat removed from the web surface may be collected in a blow-off hood 25. The air knife 4 in the illustrated embodiment comprises an air chamber 6 that ejects air through a narrow slot orifice 7 which extends across the entire machine width. The slot orifice 7 and the air knife 4 are arranged or oriented to eject a stream of air in the reverse direction to the travel of the web 5. Since the coating mix dries and its solids content and viscosity increase after its application to the base web due to mechanisms such as, for example moisture absorption by the web 5, it is desirable that the distance of the air knife 4 from the applicator apparatus 2 be adjustable to permit the adjustment of the air knife assembly 4 with its backing roll 3 to as close to the application zone as required.

Figure 2:
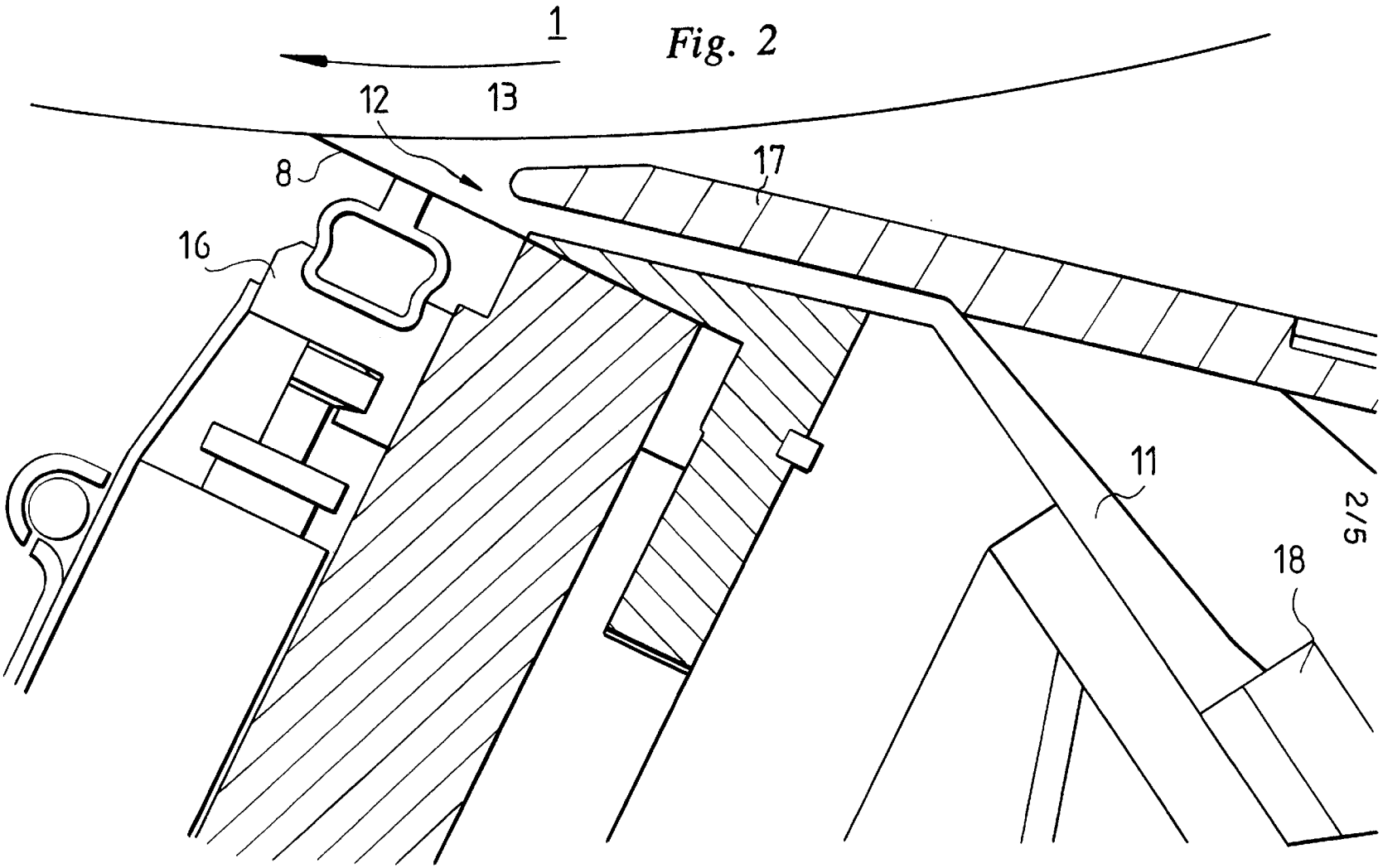
FIG. 2 is an enlarged cross-sectional view of the applicator apparatus as illustrated in FIG. 1.

Shown in FIG. 1 is an applicator apparatus provided with a smoothing/premetering blade 8. The applicator apparatus is adapted in conjunction with a rotating backing roll 1 around which the web 5 to be coated passes. Located at an underside of the backing roll 1 is an applicator that extends over the entire cross-machine width of the web 5 and has its framework formed by a support beam 9 having an approximately triangular cross-section. Through a feed channel, which extends over the entire cross-machine width of the web 5 along the support beam 9 on the incoming side of the web, the coating mix is guided into a chamber-like space 10, wherefrom the coating mix under pressure flows to the web via a narrow, flat slot-orifice channel 11. The channel extends over the entire web width and opens at the stem of the smoothing/premetering blade 8. Adapted to the orifice channel 11 is a comb-like flow-laminarizing element 18. Particularly at the orifice tip, the orifice channel 11 is very narrow with respect to conventional coating mix feed channels typically having the width of the exit slot 12 as narrow as 3–5 mm. The smoothing/premetering blade 8 is supported at its stem by a blade holder 13. The blade 8 rests flexibly against the web 5 at a small angle, and during operation it is elevated away from the web. The angle of the blade 8 is typically smaller than 20° and most advantageously less than 10°. The blade support 13 is designed so that no step is formed between the exit slot 12 and the stem of the blade 8 so as to facilitate laminar flows. Particularly at the side of the orifice channel 11, the blade support 13 has a wedge-shaped cross-section tapering toward the tip of the blade 8. The purpose of such a support arrangement is to keep the flow of coating mix laminar from the orifice channel 11 up to the tip of the blade 8. The loading of the smoothing/premetering blade 8 can be adjusted by means of separate blade load control apparatus 16 (see FIG. 2). The load control apparatus 16 is divided into independent control zones over its cross-machine width so as to offer variable blade loading in that direction. The apparatus 16 thus permits the adjustment of the applied coat weight and thereby obtains a desired coat profile across the width of the web. Since several different blade loading arrangements are well known in the art, a more detailed description of such an apparatus is omitted herein.

The coating mix is fed at a high speed such as, for example in excess of 1 m/s. In accordance with the present invention, an excess of the applied coating mix is guided in the reverse direction to the travel of the web 5 past an upper lip 17 of the orifice channel 11. This excess mix is particularly important to the successful outcome of the coating process since it plays a major role in assuring a smooth and homogeneous coat. The excess mix reverse flow (or return flow) 14 also permits an extremely accurate control of the amount of coating mix applied to the web 5 as well as the adjustment of the coat thickness including very thin coats. The coat thickness adjustment may be implemented by an ordinarily skilled artisan by either controlling the blade load or adjusting the feed rate of fresh coating mix; however, the best result is obtained by a combination of both of these control methods. The return flow 14 of the excess coating mix may be collected in an overflow trough 15. An apparatus of the above-described type is known in the art and a more detailed description thereof can be found in U.S. Pat. No. 5,104,697.

Figure 3:
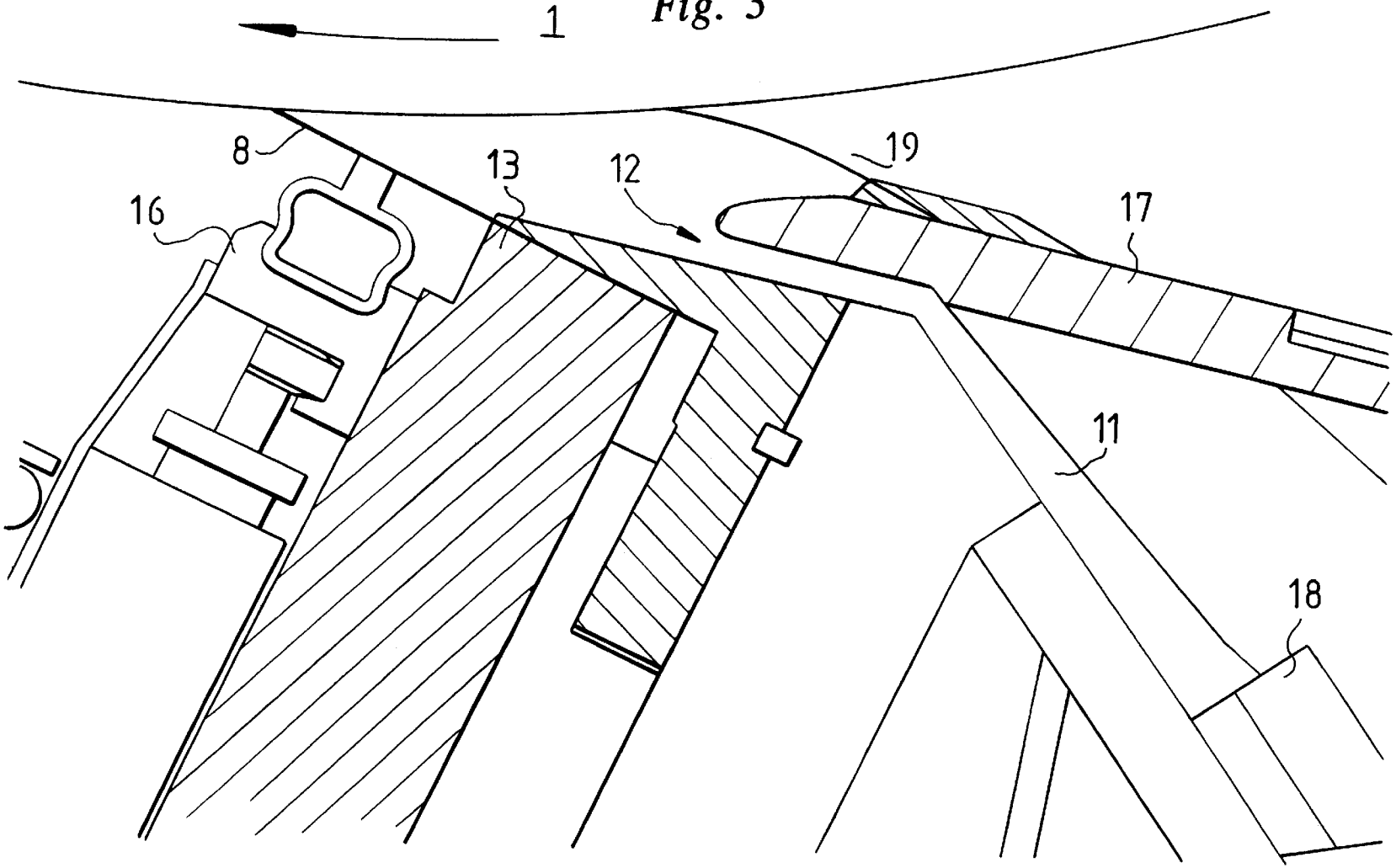
FIG. 3 is a cross-sectional view of another embodiment of the applicator apparatus of FIG. 1.
Figure 4:
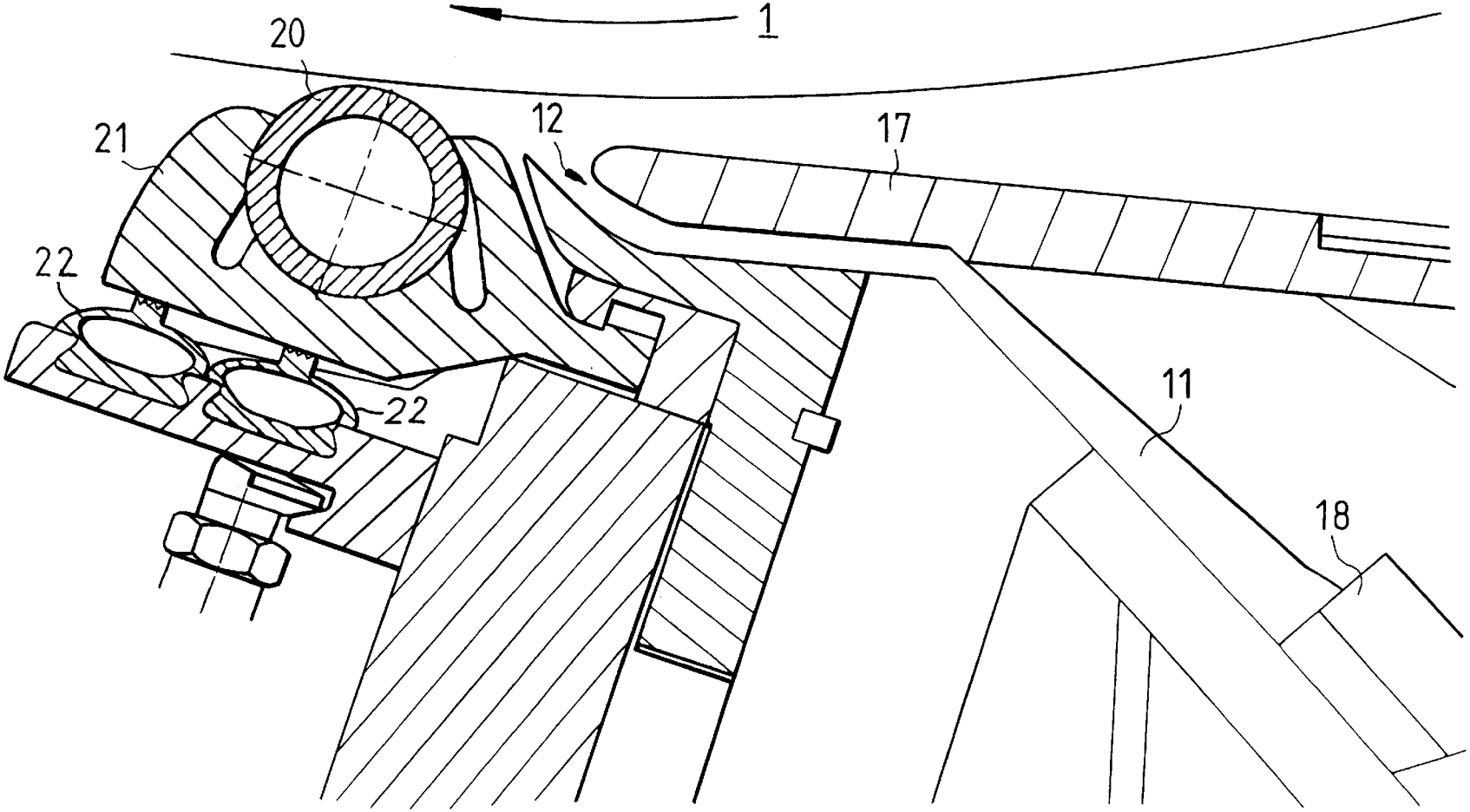
FIG. 4 is a cross-sectional view of still another embodiment of the applicator apparatus of FIG. 1.
Figure 5:
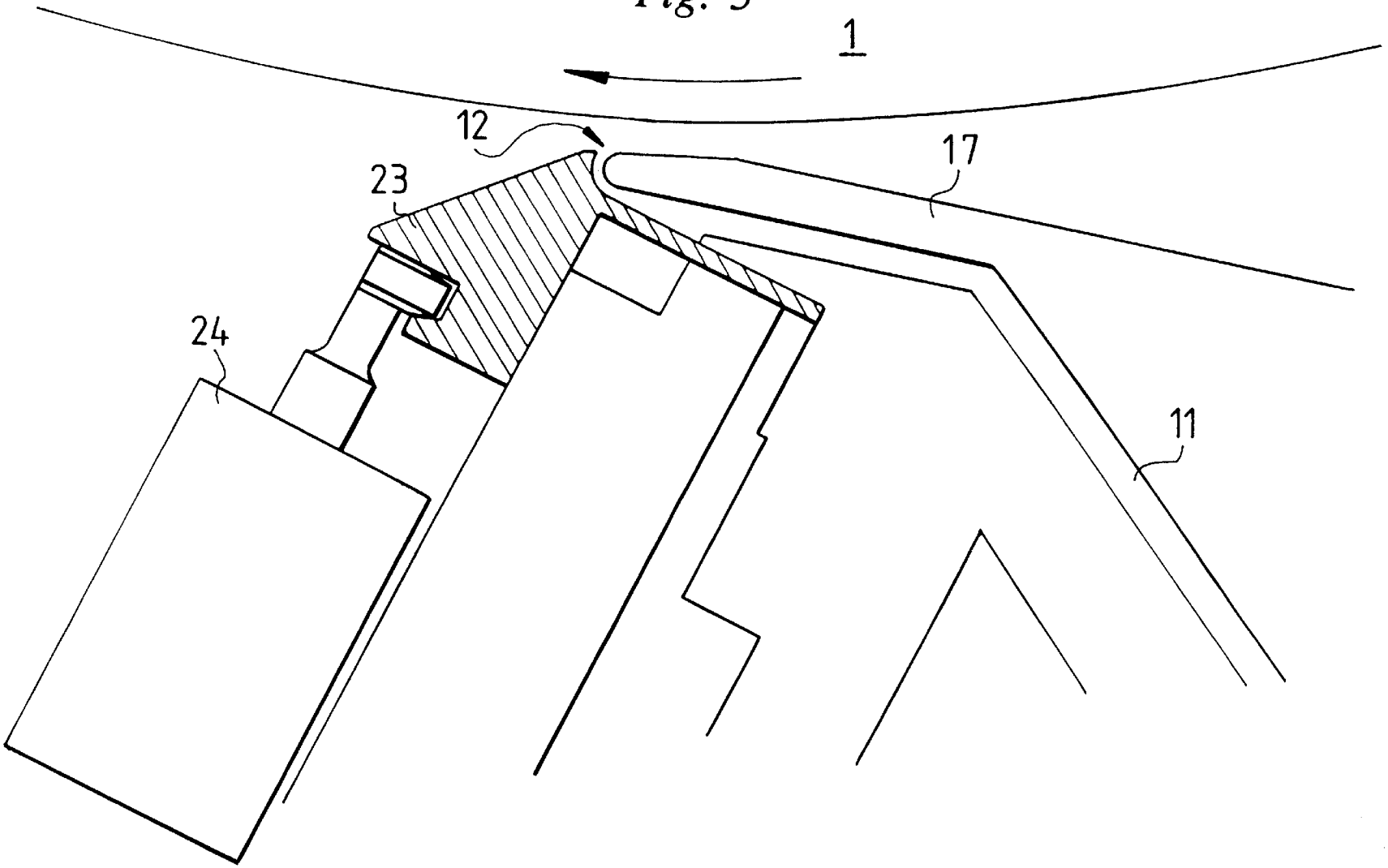
FIG. 5 is a cross-sectional view of yet another embodiment of the applicator apparatus of FIG. 1.

Alternative embodiments of the applicator apparatus are shown in FIGS. 3–5. The applicator illustrated in FIG. 3 is similar to that shown in FIG. 2 except that the upper lip 17 of the slot orifice 12 is complemented with a weir blade 19 resting against the backing roll 1. This weir blade 19 is preferably inclined at a small angle with respect to the web and preferably made of a flexible material so that it conforms to the web contour. The weir blade 19 is advantageously provided with holes. The holes permit sufficient reverse flow against the web travel and thus feed some coating mix as a lubricant into the nip between the web and the weir blade 19. A function of the weir blade 19 is to elevate the coating mix pressure at the zone provided by the slot orifice 12, so that even a smaller amount of coating mix is sufficient for applying a high-solids coat. The applicator apparatus described herein is particularly suited for coating at a low web speed.

In another embodiment of the apparatus shown in FIG. 4, the smoothing/premetering blade is replaced by a doctor rod 20. The doctor rod 20 is mounted to a floating doctor rod holder 21 which is pushed toward the web by means of pneumatic tubes 22. The doctor rod 20 may be smooth or grooved. In comparison with the earlier described applicators, the doctor rod 20 has the same benefits and drawbacks as blade doctors, and when required, it may also be complemented by a weir blade (not shown) so as to ensure sufficient application pressure at low web speeds.

With reference to FIG. 5, another embodiment of the slot-orifice applicator apparatus is shown therein, which applicator apparatus comprises an upper lip 17 and a lower lip 23. The slot orifice 12 of the applicator is formed by the rounded tip of the upper lip 17 and by the conformingly curved portion of the lower lip 23. The path of the coating mix flow starts from the narrow flat channel 11 and tapers toward the slot orifice 12. The width of the channel 11 at its entrance may be approximately 0.5–10 mm but is preferably in the range of 1.5–4 mm. Of course, the length of the channel 11 in the cross-machine direction must extend at least across the entire width of the web. The width of the orifice slot 12 may be in the range of 0.5–10 mm, however, so that at its exit the slot is slightly tapered relative to the inner width of the channel 11. The gap distance between the slot-orifice applicator apparatus and the backing roll 1 or surface of the web may be in the range of 1–20 mm, but preferably between 3–8 mm. The gap distance may be selectively adjusted by moving the lower lip using an adjustment apparatus 24. In addition, the upper lip may be made transferrable relative to the coater framework, whereby the width of the slot-orifice channel 11 may be made adjustable if desired. The rounded tip of the upper lip 17 induces a so-called Coanda effect, whereby the coating mix jet tends to follow the surface of the upper lip 17 at the exit of the orifice slot and thus directs the coating mix jet in the reverse direction to the web travel. The radius of curvature of the tip may vary in the range of 1–50 mm, and is preferably in the range of 3–10 mm.

A basic precondition to the formation of a suitable jet flow of the coating mix is that the surface of the lower lip 23 of the slot orifice 12 curves toward the direction reverse to the web travel, thereby achieving the desired aiming of the coating mix jet.

In accordance with the present invention, the amount of coating mix feed can be adjusted in many different ways, the most important of which is the control of the coating mix flow rate by adjusting the volume rate of fresh coating mix pumping. Simultaneously or alternatively, the width of the slot orifice 12 or the jet direction may be varied. The jet direction may be altered by, for example, rotating the applicator apparatus with its support beam in the same manner that the angle of the doctor blades is adjusted. Such a slot-orifice coating apparatus is described in greater detail in Finnish patent application 924,841.

The above-described types of coater assemblies are operated as follows. The incoming web passes around the backing roll 1 of the applicator apparatus whereby to the top side of the web is coated with a coat thickness closely corresponding to the desired coat weight using a slot-orifice applicator 2. The coat thickness having been so applied enables the air knife 4 to smooth the coat at the normally higher web speed; different coat solids and coat viscosity may be selectively employed to achieve the desired finished coat weight. Of course, when the coater apparatus is run at higher web speeds and employs higher coating mix viscosities, the applied coat thickness must be closer to the finished coat weight than when it operates at lower web speeds. The applied coat must however be thicker than the finished coat so as to leave the air knife 4 some excess coat to blow off in order to smooth or trim the applied coat to its finished weight. But if the initially applied coat is excessively thin, the quality of the coat may suffer since the air knife 4 may be rendered unusable, at least partially, and the finished coat weight may not meet specifications.

In the above description there are provided various embodiments of applicator apparatus in accordance with the present invention. It is demonstrated that the construction of the applicators can be varied provided that an applicator apparatus has a member that directs the coating mix to flow in the direction reverse to the web travel and that the slot orifice of the applicator apparatus applies to the web, in the travel direction of the web, only a coat thickness which closely approximates the desired finished coat weight. Of course, the present assembly and method are also suited for coating other similar materials besides board and paper.

Conceivably, the applicator apparatus and air doctor can be disposed around a single backing roll, although the construction of such an apparatus becomes extremely complicated because of difficulties such as, for example, the positioning of a fume hood between the applicator apparatus and the air doctor.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A method of coating an elongated web being advanced in a movement direction, comprising the steps of:

passing the web supportedly over a first backing roll;

applying a coating mix to a surface of the web supported on the first backing roll from a slot-orifice applicator apparatus located in proximal opposition to the first backing roll by ejecting a flow of the coating mix from the slot-orifice applicator onto the first backing roll supported web surface in a gap region defined between the slot-orifice applicator apparatus and the web so that at least a portion of the coating mix flows in a direction opposite the movement direction of the web and so that the amount of coating mix applied to the web surface is restricted, the slot-orifice applicator apparatus having a slot-orifice through which the coating mix flows, wherein said at least a portion of the coating mix is directed in said opposite direction by disposing a blade proximate the backing roll supported web surface at a blade angle relative to the web of less than approximately 20°;

continuously controlling the flow of the coating mix ejected from slot-orifice applicator apparatus onto the first backing roll supported web surface along a direction transverse to the movement direction of the web; and doctoring the applied coat on the web to a finished coat weight using an air knife disposed in confronting opposition to a second backing roll on which the web is supported and located downstream of said slot-orifice applicator apparatus.

2. The method of claim 1, wherein said applying step further comprises varying a rate of flow of the coating mix ejected from the applicator apparatus along a direction transverse to the movement direction of the web.

3. A method of coating an elongated web being advanced in a movement direction, comprising the steps of:

passing the web supportedly over a first backing roll;

applying a coating mix to a surface of the web supported on the first backing roll from a slot-orifice applicator apparatus located in proximal opposition to the first backing roll by ejecting a flow of the coating mix from the slot-orifice applicator onto the first backing roll supported web surface in a gap region defined between the slot-orifice applicator apparatus and the web so that at least a portion of the coating mix flows in a direction opposite the movement direction of the web and so that the amount of coating mix applied to the web surface is restricted, the slot-orifice applicator apparatus having a slot-orifice through which the coating mix flows;

continuously controlling the flow of the coating mix ejected from slot-orifice applicator apparatus onto the first backing roll supported web surface along a direction transverse to the movement direction of the web;

doctoring the applied coat on the web to a finished coat weight using an air knife disposed in confronting opposition to a second backing roll on which the web is supported and located downstream of said slot-orifice applicator apparatus; and pressurizing the ejected coating mix at the gap region by disposing a perforated weir blade proximate the backing roll supported web surface at a location proximate an entry side of the gap region from which the moving web enters the gap region.

4. The method of claim 3, wherein said applying step further comprises varying a rate of flow of the coating mix ejected from the applicator apparatus along a direction transverse to the movement direction of the web.

5. A method of coating an elongated web being advanced in a movement direction, comprising the steps of:

passing the web supportedly over a first backing roll;

applying a coating mix to a surface of the web supported on the first backing roll from a slot-orifice applicator apparatus located in proximal opposition to the first backing roll by ejecting a flow of the coating mix from the slot-orifice applicator onto the first backing roll supported web surface in a gap region defined between the slot-orifice applicator apparatus and the web so that at least a portion of the coating mix flows in a direction opposite the movement direction of the web and so that the amount of coating mix applied to the web surface is restricted, the slot-orifice applicator apparatus having a slot-orifice through which the coating mix flows, wherein the coating mix ejected from the applicator apparatus in said opposite direction is ejected from the slot-orifice applicator apparatus as a jet directed in said opposite direction;

continuously controlling the flow of the coating mix ejected from slot-orifice applicator apparatus onto the first backing roll supported web surface along a direction transverse to the movement direction of the web; and doctoring the applied coat on the web to a finished coat weight using an air knife disposed in confronting opposition to a second backing roll on which the web is supported and located downstream of said slot-orifice applicator apparatus.

6. The method of claim 5, wherein said applying step further comprises varying a rate of flow of the coating mix ejected from the applicator apparatus along a direction transverse to the movement direction of the web.

7. A method of coating an elongated web being advanced in a movement direction, comprising the steps of:

passing the web supportedly over a first backing roll;

applying a coating mix to a surface of the web supported on the first backing roll from a slot-orifice applicator apparatus located in proximal opposition to the first backing roll by ejecting a flow of the coating mix from the slot-orifice applicator onto the first backing roll supported web surface in a gap region defined between the slot-orifice applicator apparatus and the web so that at least a portion of the coating mix flows in a direction opposite the movement direction of the web and so that the amount of coating mix applied to the web surface is restricted, the slot-orifice applicator apparatus having a slot-orifice through which the coating mix flows, wherein a rate of flow of the coating mix ejected from the applicator apparatus is varied along a direction transverse to the movement direction of the web;

continuously controlling the flow of the coating mix ejected from slot-orifice applicator apparatus onto the first backing roll supported web surface along a direction transverse to the movement direction of the web; and doctoring the applied coat on the web to a finished coat weight using an air knife disposed in confronting opposition to a second backing roll on which the web is supported and located downstream of said slot-orifice applicator apparatus.

8. The method of claim 7 wherein said applying step further comprises directing said at least a portion of the coating mix in said opposite direction by disposing a doctoring rod proximate the backing roll supported web surface at an exit side of the gap region from which the moving web exits the gap region.

9. A device for coating an elongated web advanced in a movement direction, said device comprising:

a first backing means for supporting the moving web;

an applicator apparatus located in proximal opposition to said first backing means for ejecting a flow of a coating mix onto a surface of the web supported by said first backing means, said applicator apparatus comprising means for directing the ejected coating mix onto the first backing means supported web surface in a gap region defined between the web surface and said applicator apparatus and at least a portion of the ejected coating mix in a direction opposite said movement direction of the web so that the amount of coating mix applied to the web surface is restricted, said applicator apparatus further comprising smoothing means disposed proximate the first backing means supported web surface proximate a downstream end of the gap region for premetering and smoothing the applied coat on the web, said smoothing means comprising a blade oriented at a blade angle relative to the web of less than approximately 20°, said directing means comprising a slot-orifice defined on said applicator apparatus, said slot-orifice continuously controlling the flow of the coating mix ejected therefrom onto the first backing means supported web surface along a direction transverse to the movement direction of the web, said slot-orifice being defined by:

an upper lip disposed proximate the backing means supported web surface; and a lower lip disposed noncontactingly proximate said upper lip to define said slot orifice between spaced apart confronting surfaces of said upper and lower lips and through which the coating mix is supplied for application to the web;

an air knife positioned downstream of said applicator apparatus for doctoring the applied coat on the web to a finished coat weight using air blown by said air knife; and a second backing means disposed downstream of said first backing means and in confronting opposition to said air knife for supporting the web during said doctoring of the applied coat on the web by said air knife.

10. The device of claim 9, wherein said backing means comprises a first backing roll, and said second backing means comprises a second backing roll.

11. The device of claim 9, wherein said slot orifice has a width not greater than approximately 5 mm.

12. The device of claim 9, wherein said smoothing means further comprises means for adjusting proximity of said blade to the web surface so as to enable selective adjustability of a thickness profile of the applied coat.

13. The device of claim 9, wherein said applicator apparatus further comprises control means for adjusting the spacing between said confronting surfaces of said upper and lower lips so as to vary a width of said slot-orifice.

14. The device of claim 9, further comprising means for rotating said applicator apparatus so as to control a direction of ejection of the coating mix onto the web surface from said applicator apparatus.

15. The device of claim 9, wherein said blade is sufficiently flexible so as to conform to a contour of the web surface.

16. A device for coating an elongated web advanced in a movement direction, said device comprising:

a first backing means for supporting the moving web;

an applicator apparatus located in proximal opposition to said first backing means for ejecting a flow of a coating mix onto a surface of the web supported by said first backing means, said applicator apparatus comprising means for directing the ejected coating mix onto the first backing means supported web surface in a gap region defined between the web surface and said applicator apparatus and at least a portion of the ejected coating mix in a direction opposite said movement direction of the web so that the amount of coating mix applied to the web surface is restricted, said applicator apparatus further comprising a perforated weir blade disposed proximate the first backing means supported web surface proximate an upstream end of the gap region for providing a return flow of the ejected coating mix through perforations in the weir blade and elevating pressure of the ejected coating mix in said gap region, said directing means comprising a slot-orifice defined on said applicator apparatus, said slot-orifice continuously controlling the flow of the coating mix ejected therefrom onto the first backing means supported web surface along a direction transverse to the movement direction of the web, said slot-orifice being defined by:

an upper lip disposed proximate the backing means supported web surface; and a lower lip disposed noncontactingly proximate said upper lip to define said slot orifice between spaced apart confronting surfaces of said upper and lower lips and through which the coating mix is supplied for application to the web;

an air knife positioned downstream of said applicator apparatus for doctoring the applied coat on the web to a finished coat weight using air blown by said air knife; and a second backing means disposed downstream of said first backing means and in confronting opposition to said air knife for supporting the web during said doctoring of the applied coat on the web by said air knife.

17. The device of claim 15, wherein said backing means comprises a first backing roll, and said second backing means comprises a second backing roll.

18. The device of claim 16, wherein said slot orifice has a width not greater than approximately 5 mm.

19. The device of claim 16, wherein said applicator apparatus further comprises control means for adjusting the spacing between said confronting surfaces of said upper and lower lips so as to vary a width of said slot-orifice.

20. The device of claim 16, further comprising means for rotating said applicator apparatus so as to control a direction of ejection of the coating mix onto the web surface from said applicator apparatus.

* * * * *